US011746615B2

(12) United States Patent
McFarlin et al.

(10) Patent No.: US 11,746,615 B2
(45) Date of Patent: Sep. 5, 2023

(54) WELL TREATMENT WITH BARRIER HAVING PLUG IN PLACE

(71) Applicant: WEATHERFORD TECHNOLOGY HOLDINGS, LLC, Houston, TX (US)

(72) Inventors: Nicholas W. McFarlin, Midland, TX (US); Ryan R. Bacsik, Houston, TX (US); Nauman H. Mhaskar, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/861,686

(22) Filed: Jul. 11, 2022

(65) Prior Publication Data

US 2022/0341279 A1 Oct. 27, 2022

Related U.S. Application Data

(63) Continuation of application No. 17/618,047, filed as application No. PCT/US2020/039075 on Jun. 23, 2020, now Pat. No. 11,454,081.

(Continued)

(51) Int. Cl.

| | |
|---|---|
| ***E21B 33/12*** | (2006.01) |
| ***E21B 34/06*** | (2006.01) |
| ***E21B 43/14*** | (2006.01) |

(52) U.S. Cl.

CPC ..... *E21B 33/12* (2013.01); *E21B 34/063* (2013.01); *E21B 43/14* (2013.01)

(58) Field of Classification Search

CPC ..... E21B 33/12; E21B 34/063; E21B 43/14; E21B 33/124

See application file for complete search history.

(56) References Cited

U.S. PATENT DOCUMENTS 4,109,716 A * 8/1978 Canalizo ..... E21B 23/02 166/191

4,427,070 A 1/1984 O'Brien (Continued)

OTHER PUBLICATIONS

International Search Report and Written Opinion for International Application PCT/US20/39075 dated Jan. 14, 2021, 18 pages.

(Continued)

*Primary Examiner* — Steven A MacDonald

(74) *Attorney, Agent, or Firm* — Smith IP Services, P.C.

(57) ABSTRACT

A well barrier can include an inner mandrel, a flow passage, and a releasably secured plug. The plug blocks fluid flow through the flow passage, and includes a shoulder that prevents the plug from displacing completely through the inner mandrel. A method of treating a subterranean well can include treating a deeper zone, setting a well barrier in the well between the deeper zone and a shallower zone, then treating the shallower zone, and then applying a pressure differential from the deeper to the shallower zone, thereby displacing a plug out of the well barrier. A well treatment system can include a well barrier with a plug releasably secured to an inner mandrel. The plug is released by application of a pressure differential in a longitudinal direction, and fluid communication is unblocked by application of a pressure differential in an opposite longitudinal direction.

5 Claims, 5 Drawing Sheets

Related U.S. Application Data

(60) Provisional application No. 62/872,828, filed on Jul. 11, 2019.

(56) References Cited

U.S. PATENT DOCUMENTS

| | | | | |
|---|---|---|---|---|
| 4,784,225 | A | 11/1988 | Petersen | |
| 5,479,986 | A | 1/1996 | Gano et al. | |
| 5,607,017 | A | 3/1997 | Owens et al. | |
| 7,624,796 | B2 * | 12/2009 | Hassel-Sorensen | E21B 33/1208 166/250.08 |
| 7,712,521 | B2 * | 5/2010 | Sorensen | E21B 33/12 166/317 |
| 7,798,236 | B2 | 9/2010 | McKeachnie et al. | |
| 8,127,856 | B1 * | 3/2012 | Nish | E21B 33/1294 166/376 |
| 8,276,670 | B2 * | 10/2012 | Patel | E21B 33/1208 166/376 |
| 8,413,727 | B2 | 4/2013 | Holmes | |
| 8,631,876 | B2 | 1/2014 | Xu et al. | |
| 8,807,210 | B2 | 8/2014 | Smith et al. | |
| 9,068,447 | B2 | 6/2015 | Alvarez et al. | |
| 9,359,863 | B2 | 6/2016 | Streich et al. | |
| 9,835,006 | B2 | 12/2017 | George et al. | |
| 10,125,565 | B2 | 11/2018 | Fripp et al. | |
| 10,150,713 | B2 | 12/2018 | Doud et al. | |
| 10,337,279 | B2 | 7/2019 | Frazier | |
| 10,352,125 | B2 | 7/2019 | Frazier | |
| 10,358,887 | B2 | 7/2019 | Wise et al. | |
| 10,480,280 | B2 | 11/2019 | Hou et al. | |
| 10,508,525 | B2 | 12/2019 | Hopkins et al. | |
| 11,208,869 | B2 * | 12/2021 | Roane | E21B 34/08 |
| 2004/0163820 | A1 * | 8/2004 | Bishop | E21B 34/06 166/373 |
| 2008/0000697 | A1 * | 1/2008 | Rytlewski | E21B 34/14 166/330 |
| 2009/0056952 | A1 * | 3/2009 | Churchill | E21B 34/14 166/373 |
| 2010/0270031 | A1 * | 10/2010 | Patel | E21B 33/1208 166/376 |
| 2011/0180274 | A1 * | 7/2011 | Wang | E21B 34/14 166/386 |
| 2012/0181032 | A1 | 7/2012 | Naedler et al. | |
| 2014/0246209 | A1 * | 9/2014 | Themig | E21B 23/004 166/194 |
| 2016/0047194 | A1 | 2/2016 | Snider et al. | |
| 2016/0356137 | A1 | 12/2016 | Hardesty et al. | |
| 2017/0130553 | A1 * | 5/2017 | Harris | E21B 33/1291 |
| 2018/0038191 | A1 | 2/2018 | Davies et al. | |
| 2018/0045014 | A1 * | 2/2018 | Larisey | E21B 37/10 |
| 2018/0073321 | A1 | 3/2018 | Watson et al. | |
| 2018/0171747 | A1 | 6/2018 | Sommers | |
| 2018/0273440 | A1 | 9/2018 | Doud et al. | |
| 2018/0306027 | A1 | 10/2018 | Sherman et al. | |
| 2018/0347342 | A1 | 12/2018 | Jordan, Jr. | |
| 2018/0362415 | A1 | 12/2018 | Doud et al. | |
| 2019/0078414 | A1 | 3/2019 | Frazier | |
| 2019/0186248 | A1 | 6/2019 | Sherman | |
| 2019/0323314 | A1 | 10/2019 | Hughes et al. | |
| 2020/0049000 | A1 | 2/2020 | Sherman et al. | |
| 2020/0080396 | A1 | 3/2020 | Subbaraman et al. | |
| 2020/0115988 | A1 * | 4/2020 | Wilcox | E21B 43/26 |
| 2022/0205333 | A1 | 6/2022 | McFarlin | |

OTHER PUBLICATIONS

Terves Inc., SmartCore Dissolvable Chemical Carrier, web page dated Feb. 28, 2020, 7 pages.

Canadian Office Action dated Mar. 18, 2022 for CA Patent Application No. 3,143,229, 5 pages.

* cited by examiner

WELL TREATMENT WITH BARRIER HAVING PLUG IN PLACE

CROSS-REFERENCE TO RELATED APPLICATIONS

This application is a continuation of U.S. application Ser. No. 17/618,047 filed on 10 Dec. 2021, which is a national stage under 35 USC 371 of International Application No. PCT/US20/39075 filed on 23 Jun. 2020, which claims the benefit of the filing date of U.S. Provisional Application No. 62/872,828 filed on 11 Jul. 2019. The entire disclosures of these prior applications are incorporated herein by this reference.

TECHNICAL FIELD

This disclosure relates generally to equipment utilized and operations performed in conjunction with a subterranean well and, in at least one example described below, more particularly provides for well treatment with a barrier having a plug in place.

BACKGROUND

A well barrier (such as, a packer, bridge plug or frac plug) is typically set in a well for the purpose of isolating sections of a wellbore or tubular string interior from each other. For this purpose, the well barrier includes an annular seal element for sealingly engaging a well surface (such as, a wall of the wellbore or tubular string interior), so that fluid communication is prevented through an annulus formed between the well barrier and the well surface. In most cases, the well barrier also includes slips or other gripping elements for anchoring the well barrier against movement relative to the well surface.

It will, thus, be readily appreciated that improvements are continually needed in the art of designing, constructing and utilizing barriers for use in a subterranean well. It is among the objects of this disclosure to provide such improvements to the art.

DETAILED DESCRIPTION

Figure 1:
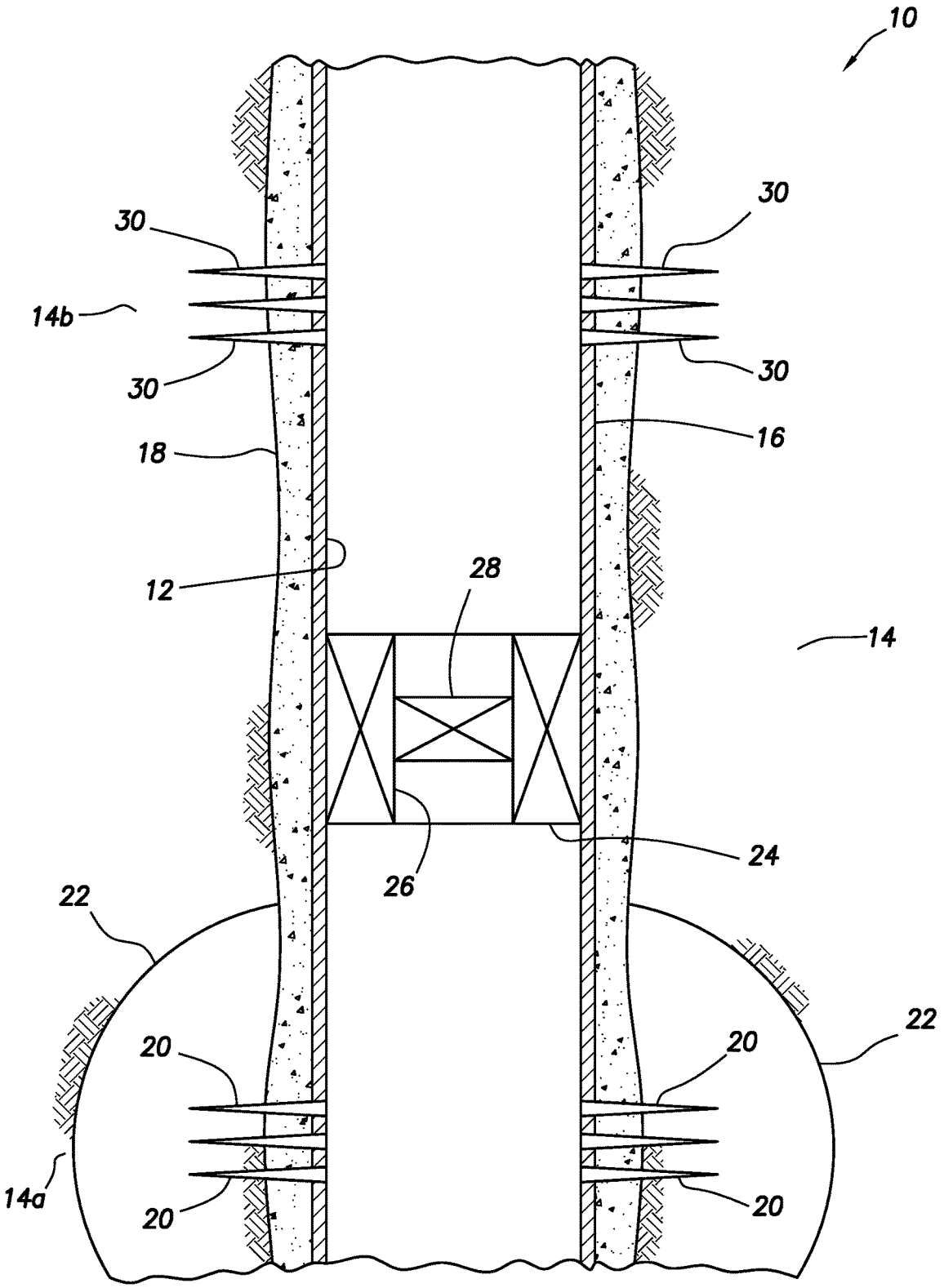
FIG. 1 is a representative partially cross-sectional view of an example of a well treatment system and associated method which can embody principles of this disclosure.

Representatively illustrated in FIG. 1 is a well treatment system 10 and an associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As depicted in FIG. 1, a wellbore 12 has been drilled into an earth formation 14. The wellbore 12 is lined with casing 16 and cement 18. The wellbore 12 is generally vertical as shown in FIG. 1, but in other examples the wellbore may be generally horizontal or otherwise inclined from vertical.

Perforations 20 have been formed from the wellbore 12 into a zone 14*a* of the formation 14. An explosive jet-type perforator, an abrasive perforator or any other means of forming the perforations 20 may be used.

The zone 14*a* is then treated, for example, by pumping treatment fluids from surface into the zone via the perforations 20 to form fractures 22. In other examples, the zone 14*a* may be acidized, treated with permeability enhancers or conformance treatments, etc. The scope of this disclosure is not limited to any particular type of treatment operation performed for the zone 14*a*.

A well barrier 24 is then set in the wellbore 12 above (at a shallower depth along the wellbore than) the perforations 20. The well barrier 24 may be of the type known to those skilled in the art as a "frac plug" that is set between zones to isolate a deeper, treated zone from a shallower, untreated zone. However, the scope of this disclosure is not limited to use of a frac plug, since the principles of this disclosure may be incorporated into other types of well barriers.

In this example, the barrier 24 has a flow passage 26 extending longitudinally through the barrier. A plug 28 is installed in the flow passage 26 and sealingly engaged therein, so that fluid communication is prevented between upper and lower sections of the wellbore 12.

Perforations 30 are then formed from the wellbore 12 into another zone 14*b* of the formation 14 (or another formation). The zone 14*b* is then treated, for example, by pumping fluids from the surface into the zone via the perforations 30 to form fractures in the zone or otherwise treat (e.g., stimulate, fracture, acidize, etc.) the zone.

When it is desired to produce fluids from the zone 14*a*, the barrier 24 can be drilled out or otherwise removed. As described more fully below, the plug 28 can include a feature that permits fluid communication from below to above the plug 28 prior to drilling out or otherwise removing the barrier 24, for example, if some flow-back of fluids from the zone 14*a* is desired.

The internal plug 28 provides operational time and cost savings. The internal plug 28 will not move away from the barrier 24 after it is set. The internal plug 28 can prevent cross flow from lower zones to upper zones through the passage 26, without the risk of permanent blockage of flow-back from the zone 14*a*. The internal plug 28 can be removable, allowing an additional perforating run to be completed, for example, by conventional pump-down of wireline perforating guns.

By placing the plug 28 in the internal flow passage 26 of the barrier 24, pressure isolation is achieved between the zones 14*a,b*. The plug 28 can be capable of supporting full differential pressure from above, and a pre-determined pressure differential from below (sufficient to prevent inadvertent cross flow from a lower to an upper zone). The plug 28 can be yielded or removable by controlled pressure changes in the well.

Figure 2:
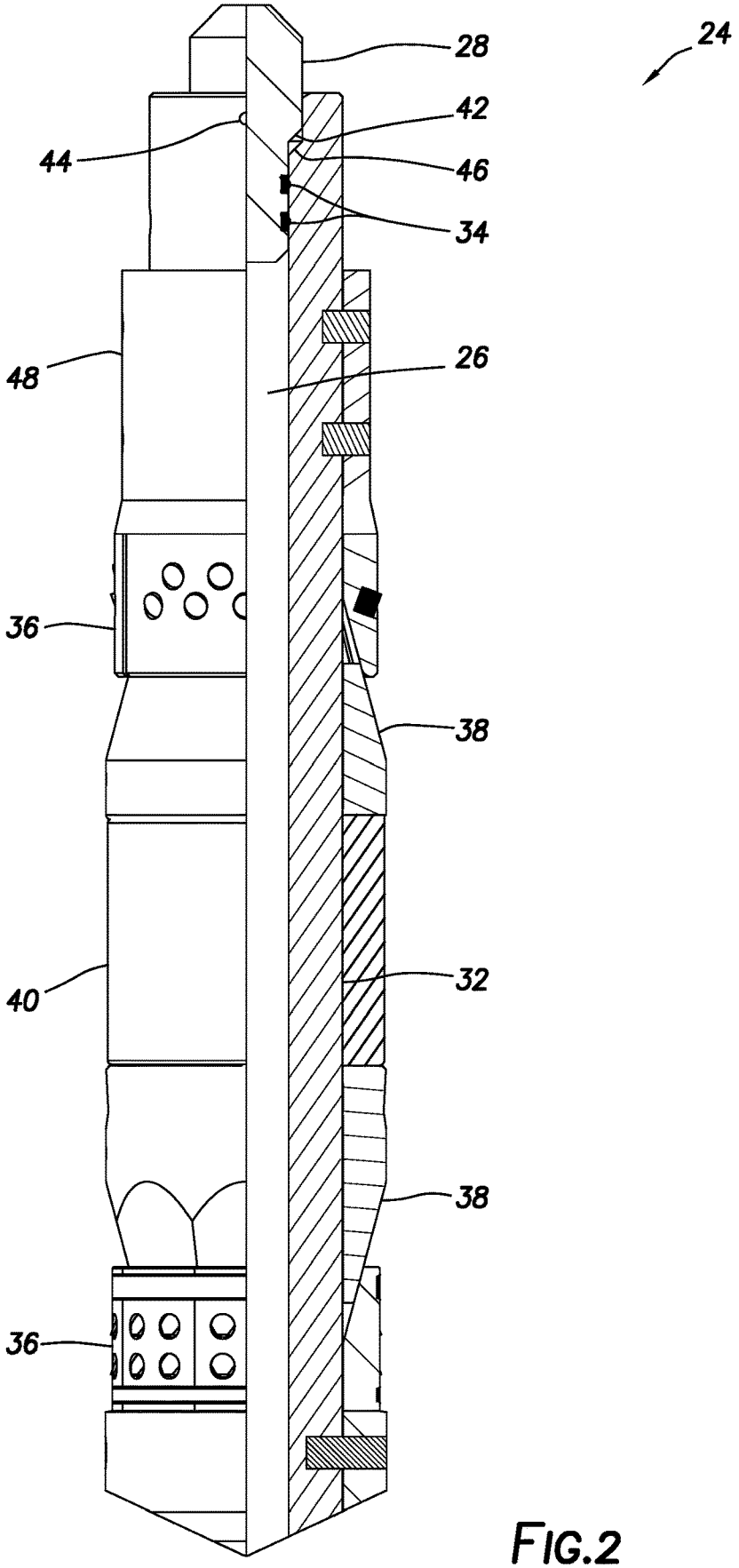
FIG. 2 is a representative cross-sectional view of a well barrier that may be used in the FIG. 1 system and method, and which can embody the principles of this disclosure.

Referring additionally now to FIG. 2, a more detailed example of the well barrier 24 is representatively illustrated. The FIG. 2 barrier 24 may be used in the system 10 and method of FIG. 1, or it may be used with other systems and methods. For convenience, the barrier 24 is described below as if it is used in the system 10 and method of FIG. 1.

As depicted in FIG. 2, the barrier 24 includes an inner generally tubular mandrel 32 having the flow passage 26 extending longitudinally through the mandrel. Slips 36, cones or wedges 38 and an annular seal element 40 are carried on the mandrel 32. In other examples, the well barrier 24 may include other or differently configured components, or different combinations of components. Thus, the scope of this disclosure is not limited to any particular components or combination of components of the well barrier 24.

A conventional setting tool (not shown) of the type well known to those skilled in the art may be used to set the barrier 24 in the casing 16. For example, the setting tool can apply an upwardly directed force to the mandrel 32, while preventing upward displacement of a setting ring 48 releasably secured to the mandrel.

When the barrier 24 is set in the casing 16, the slips 36 are radially outwardly extended into gripping engagement with the casing, and the seal element 40 is radially outwardly extended into sealing engagement with the casing. In other examples, the barrier 24 may be set in an uncased or open hole section of a wellbore, or in another type of tubular (such as, liner or tubing, etc.).

The plug 28 initially prevents flow through an upper end of the flow passage 26. The plug 28 is secured in place by a shear pin or other type of shear member 44. Seals 34 carried on the plug 28 are sealingly engaged in the flow passage 26.

If a sufficient positive pressure differential from above is applied to the plug 42, the shear member 44 will shear. The pressure differential sufficient to shear the shear member 44 may be less than or equivalent to a pressure differential experienced during treatment of the zone 14*b* above the barrier 24.

After the shear member 44 has been sheared, a downwardly facing shoulder 42 formed on the plug 28 can abut an upwardly facing shoulder 46 formed in the mandrel 32. In this manner, the plug 28 can withstand a very large pressure differential from above while the plug 28 is sealingly received in the flow passage 26.

If a pressure differential from below is applied to the plug 42, the shear member 44 will initially resist displacement of the plug 28 from the flow passage 26, unless the shear member has already been sheared as described above. If the shear member 44 has previously been sheared, then only minimal pressure differential from below will be needed to displace the plug 28 out of the flow passage 26. Fluid communication will then be permitted between the upper and lower sections of the wellbore 12 (above and below the barrier 24) through the flow passage 26.

If the shear member 44 has not previously been sheared, then a sufficient pressure differential from below can be applied to the plug 28, until the shear strength of the shear member 44 is exceeded. When the shear member 44 is sheared, the plug 28 will no longer be secured in the flow passage 26, and fluid communication will then be permitted between the upper and lower sections of the wellbore 12 (above and below the barrier 24) through the flow passage.

Thus, if it is desired to permit fluid communication between the upper and lower sections of the wellbore 12 after the barrier 24 has been set in the casing 16, pressure in the wellbore above the barrier can be increased to thereby shear the shear member 44. The plug 28 will displace downward, until the shoulders 42, 46 are in contact. The pressure in the wellbore 12 above the barrier 24 can then be reduced, so that a positive pressure differential from below the plug 28 causes it to displace upwardly out of the flow passage 26.

For example, it may be desirable to permit fluid communication between the upper and lower sections of the wellbore 12 in order to pump down another perforating gun to the zone 14*b*, in the event that a previous perforating gun failed to form the perforations 30. As another example, it may be desirable to permit fluid communication between the upper and lower sections of the wellbore 12 in order to obtain flow-back or production of fluids from the zone 14*a*.

Note that it is not necessary in any of the examples described herein for the shear member 44 to be used to releasably secure the plug 28 in the flow passage 26. Other devices (such as, snap rings, collets, latches, etc.) may be used to releasably secure the plug 28 in the flow passage 26 in keeping with the principles of this disclosure.

Figure 3:
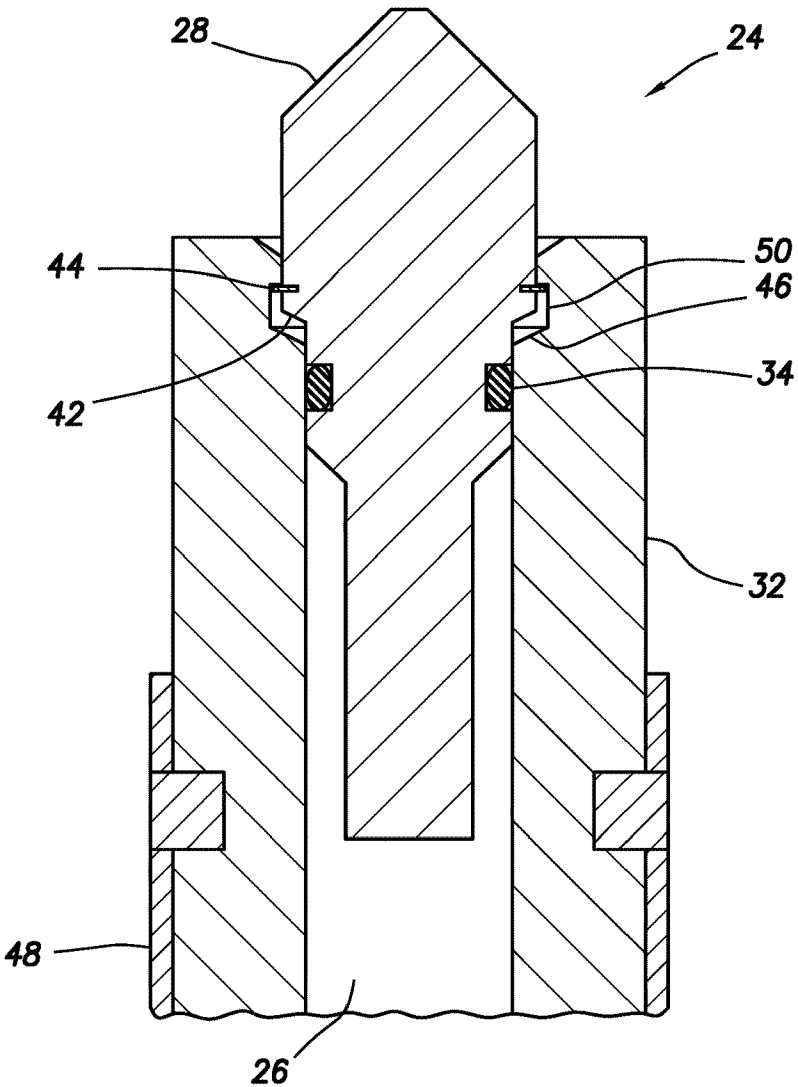
FIG. 3 is a representative cross-sectional view of an upper section of another example of the well barrier.

Referring additionally now to FIG. 3, another example of the barrier 24 is representatively illustrated. Only an upper section of the barrier 24 (including the plug 28 received in the mandrel 32) is depicted in FIG. 3.

In the FIG. 3 example, the plug 28 can be removed from the passage 26 by applying a sufficient positive pressure differential from below the plug, without first applying a positive pressure differential from above the plug. As depicted in FIG. 3, the shear pin or shear member 44 of the FIG. 2 example is instead a shear ring (such as, a C-ring or snap ring). The shear member 44 of the FIG. 3 example is carried on the plug 28 and is received in an annular recess 50 formed in the mandrel 32.

When a pressure differential is applied from above, the shoulders 42, 46 contact each other to limit downward displacement of the plug 28. However, the shear member 44 does not experience any shear stress due to the pressure differential applied from above the plug. Thus, large pressure differentials may be applied from above (such as, during fracturing or other stimulation or treatment operations), without affecting the pressure holding capability of the plug 28.

When a pressure differential is applied from below, the plug 28 is biased upward, but is prevented from displacing out of the passage 26 by the shear member 44. The shear member 44 will shear and thereby permit the plug 28 to displace upward out of the passage 26 when the pressure differential applied from below reaches a predetermined level sufficient to shear the shear member.

Figure 4:
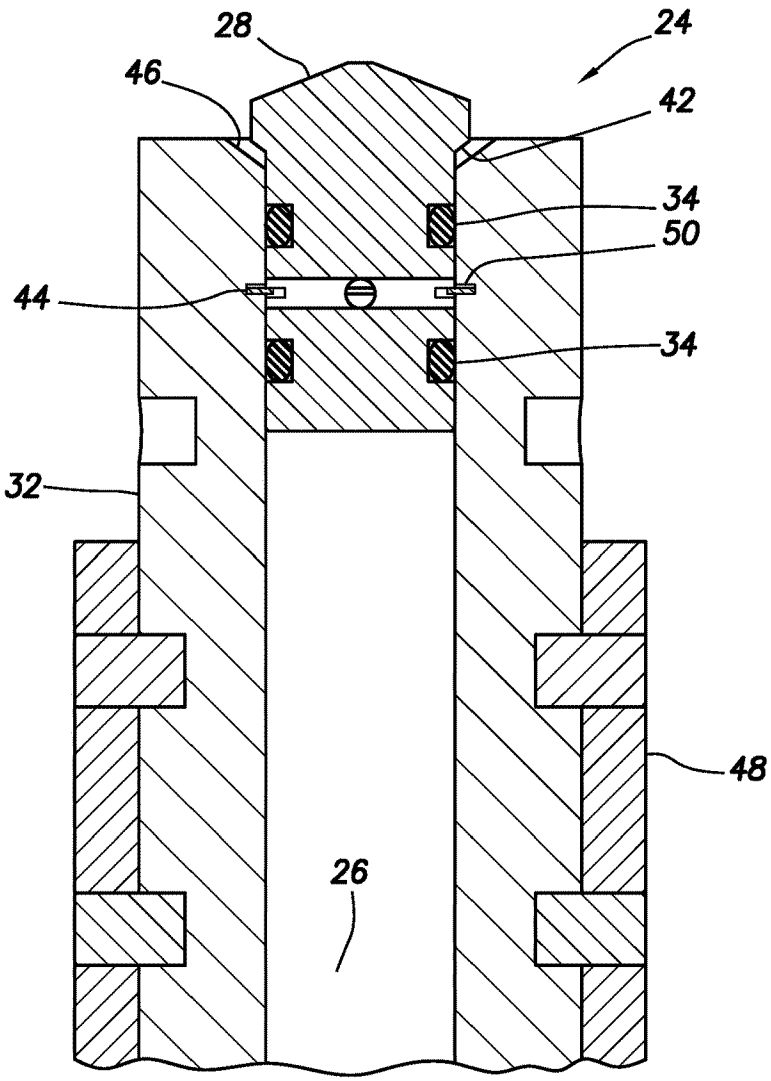
FIG. 4 is a representative cross-sectional view of an upper section of a further example of the well barrier.

Referring additionally now to FIG. 4, another example of the barrier 24 is representatively illustrated. Only an upper section of the barrier 24 (including the plug 28 received in the mandrel 32) is depicted in FIG. 4.

In the FIG. 4 example, the shear member 44 is in the form of a shear ring, as in the FIG. 3 example. However, in the FIG. 4 example, the shear member 44 is positioned between two of the seals 34.

When a sufficient positive pressure differential is applied from above, the shear member 44 will shear, and then the shoulders 42, 46 will contact each other to limit downward displacement of the plug 28. Thus, large pressure differentials may be applied from above (such as, during fracturing or other stimulation or treatment operations), without affecting the pressure holding capability of the plug 28.

When a positive pressure differential is applied from below (after the shear member 44 has been sheared), the plug 28 is biased upward and out of the passage 26. Thus, if it is desired to permit fluid communication between the upper and lower sections of the wellbore 12 after the barrier 24 has been set in the casing 16, pressure in the wellbore above the barrier can be increased to thereby shear the shear member 44. The plug 28 will displace downward, until the shoulders 42, 46 are in contact. The pressure in the wellbore 12 above the barrier 24 can then be reduced, so that a positive pressure differential from below the plug 28 causes it to displace upwardly out of the flow passage 26.

Figure 5:
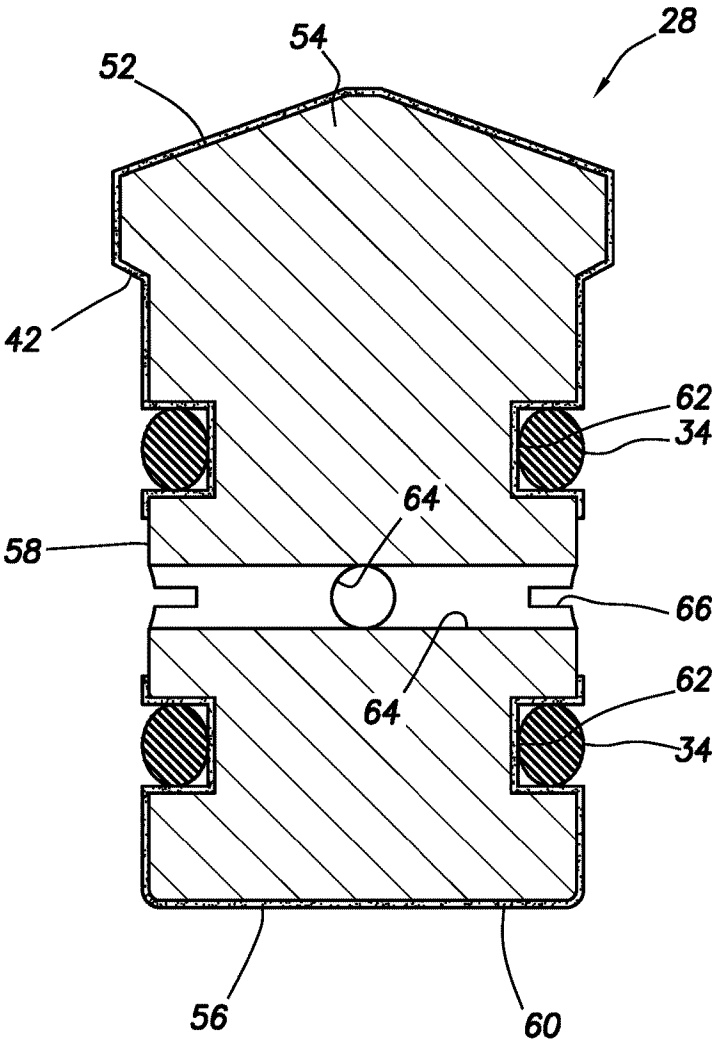
FIG. 5 is a representative cross-sectional view of an example of a degradable plug that may be used in the FIG. 4 well barrier.

Referring additionally now to FIG. 5, a cross-sectional view of the plug 28 of the FIG. 4 example is representatively illustrated. In this view, it may be more clearly seen that a body 52 of the plug 28 is made of a material 54 that dissolves or otherwise readily degrades (for example, oxidizes, disperses, corrodes, hydrates, etc.) in response to contact with a fluid in a wellbore (such as, the treatment fluid used in the wellbore 12 of the FIG. 1 system 10 and method). Examples of suitable materials include, but are not limited to, polylactic acid, ploy-glycolic acid, magnesium, anhydrous boron, various salts, etc.

A coating 56 covers the body 52, except in an area 58 positioned longitudinally between the seals 34. The coating 56 is made of a material 60 that is not dissolvable or readily degradable in wellbore fluid.

While the plug 28 is sealed in the flow passage 26 as depicted in FIG. 4, the seals 34 carried in annular grooves 62 on the body 52 isolate the uncoated area 58 from fluid in the wellbore 12. However, after the shear member 44 has been sheared, and the plug 28 has been displaced out of the flow passage 26, the uncoated area 58 will be exposed to the fluid in the wellbore 12, and the body material 54 will begin to dissolve or otherwise degrade.

Note that openings 64 are formed through the body 52 at the uncoated area 58 between the seals 34, so that wellbore fluid can contact more surface area of the material 54, to thereby enhance the degrading of the body. In addition, an annular groove 66 for retention of the shear member 44 is formed in the uncoated area 58 between the seals 34. However, it is not necessary in keeping with the scope of this disclosure for the openings 64 to be provided, or for the groove 66 to be positioned between the seals 34.

By dissolving or otherwise degrading the plug 28 after it has been displaced out of the flow passage 26, the plug cannot obstruct any subsequent operations. For example, drilling out the barrier 24 after the treatment operation may be expedited or otherwise facilitated by removing the plug 28 prior to drilling out the barrier. As another example, it may be desired to again isolate a deeper zone (such as zone 14*a*) from pressure applied to a shallower zone (such as zone 14*b*), and in that situation it would be beneficial to be able to again plug the flow passage 26. However, the scope of this disclosure is not limited to any particular reason for degrading the plug 28.

Figure 6:
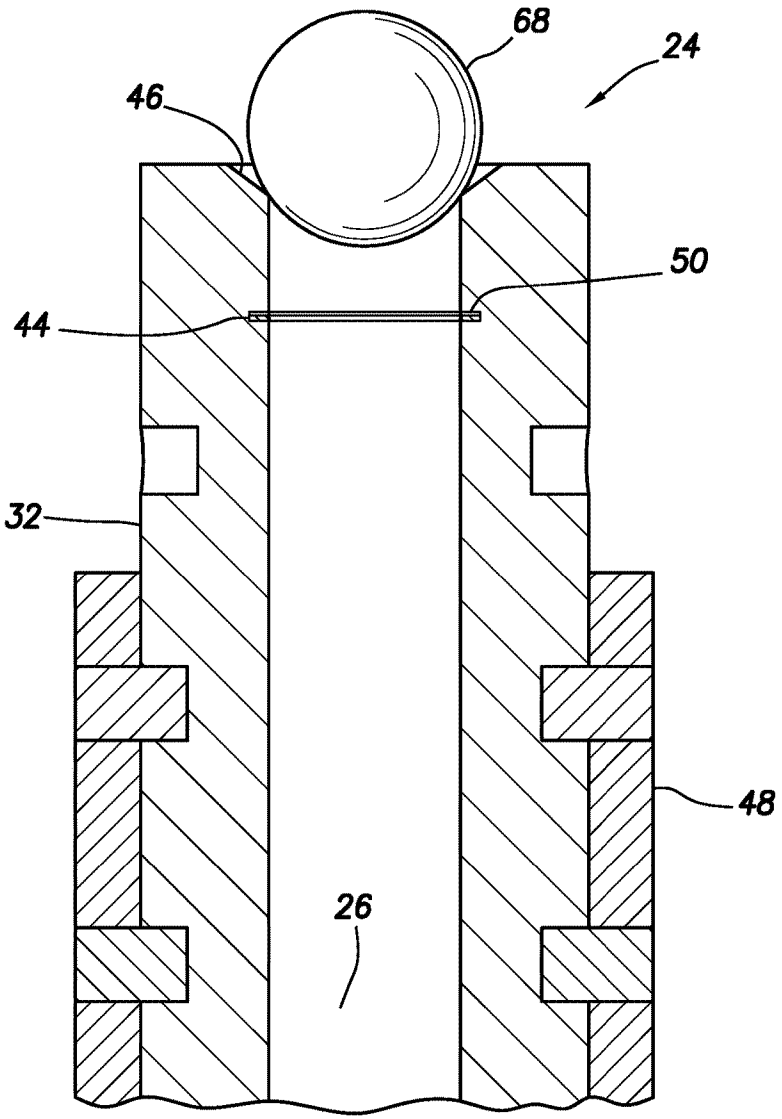
FIG. 6 is a representative cross-sectional view of the upper section of the FIG. 4 well barrier, with another plug sealed with the well barrier.

Referring additionally now to FIG. 6, a cross-sectional view of the upper section of the FIG. 5 example of the barrier 24 is representatively illustrated. As depicted in FIG. 6, the plug 28 has been displaced out of the flow passage 26 after the shear member 44 has been sheared. The plug 28 has dissolved or otherwise degraded, and is no longer present in the wellbore with its unitary body 52.

Another plug 68 has been deployed into the wellbore, in order to prevent downward flow through the flow passage 26. In this example, the plug 68 is in the form of a ball or sphere capable of sealingly engaging the mandrel 32 (such as, at the shoulder 46). In other examples, the plug 68 could be in the form of a dart or other structure, and could have seals carried thereon for sealing engagement with the flow passage 26.

In the FIG. 6 example, the plug 68 will prevent (or at least substantially restrict) downward flow through the flow passage 26. This will isolate the lower zone 14*a* from the upper zone 14*b* in the FIG. 1 system 10 and method, for example, in the event that it is desired to re-fracture or otherwise treat the upper zone after the plug 28 has been displaced out of the flow passage 26. However, subsequent flow-back or production of fluids from the lower zone 14*a* will be permitted by the plug 68, since the plug does not prevent upward flow through the flow passage 26.

Figure 7:
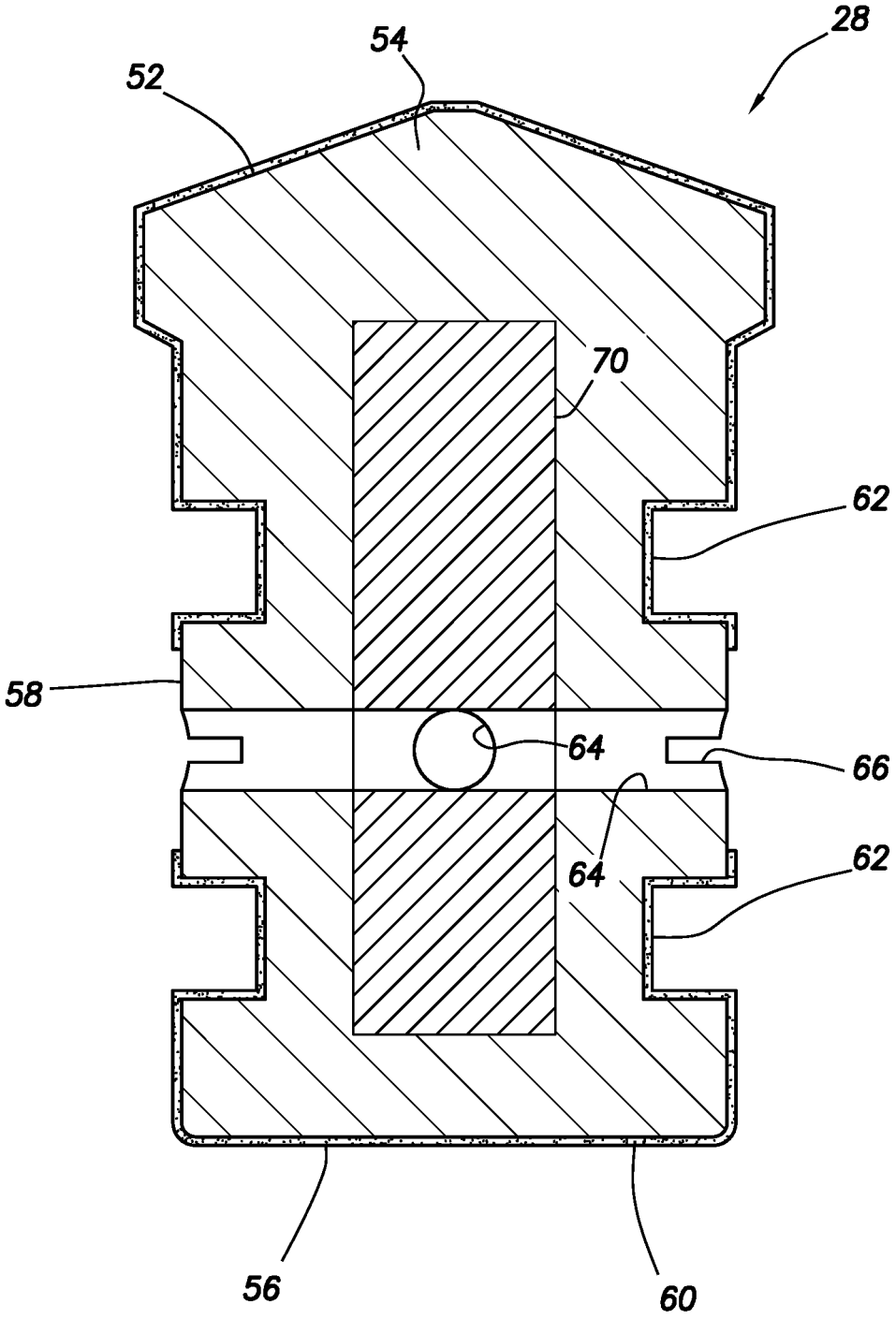
FIG. 7 is a representative cross-sectional view of another example of a degradable plug that may be used in the FIG. 4 well barrier.

Referring additionally now to FIG. 7, a cross-sectional view of another example of the plug 28 is representatively illustrated. In this example, the plug 28 has a degrading material 70 positioned in the body 52 and exposed to the openings 64.

The degrading material 70 enhances the degradation of the body material 54 after the plug 28 has been displaced from the flow passage 26 and the wellbore fluid is able to contact the body material at the uncoated area 58 and via the openings 64. In one example, in which the body material 54 is degradable by exposure to acid, the degrading material 70 could be an acid (such as, hydrochloric acid) in solid form. The acid is released upon exposure of the degrading material 70 to the wellbore fluid (such as, water, sea water, brine, treatment fluid, etc.), which thereby enhances degradation of the body material 54.

The degrading material 70 may enhance the degradation of the body material 54 in a variety of different ways. For example, the degrading material 70 may function to change a pH of the wellbore fluid near the plug 28, the degrading material may quicken the dissolving or other degrading of the body material 54, or the degrading material may ensure that the body material is more completely or thoroughly dissolved or otherwise degraded. Thus, the scope of this disclosure is not limited to any particular manner in which the degrading material 70 enhances the degradation of the body material 54.

It may now be fully appreciated that the above disclosure provides significant advancements to the art of designing, constructing and utilizing well barriers. In examples described above, the well barrier 24 includes a plug 28 that initially prevents or blocks flow through the flow passage 26 in the inner mandrel 32, but can be conveniently displaced so that it no longer blocks flow by application of appropriate pressure differential(s) across the plug.

The above disclosure provides to the art a well barrier 24 for use in a subterranean well. In one example, the well barrier 24 includes an inner mandrel 32, a flow passage 26 extending longitudinally through the inner mandrel 32, and a plug 28 releasably secured relative to the inner mandrel 32. The plug 28 blocks fluid flow through the flow passage 26 and includes a shoulder 42 that prevents the plug 28 from displacing through the inner mandrel 32 in a first longitudinal direction.

In any of the examples described herein:

At least one seal 34 may be sealingly engaged between the plug 28 and the flow passage 26. The "at least one seal" may comprise first and second seals 34. A body 52 of the plug 28 may be coated with a coating material 60, and an area longitudinally between the first and second seals 34 may not be coated with the coating material 60. A degrading material 70 may be positioned in the body 52 of the plug 28.

The plug 28 may be releasable for displacement out of the inner mandrel 32 in response to application of a positive pressure differential in the first longitudinal direction. The plug 28 may be releasable for displacement out of the inner mandrel 32 in response to application of a positive pressure differential in a second longitudinal direction opposite to the first longitudinal direction.

A shear member 44 may releasably secure the plug 28 in the flow passage 26.

A method of treating a subterranean well is also provided to the art by the above disclosure. In one example, the method can include: treating a first formation zone 14*a*; setting a well barrier 24 in the well between the first formation zone 14*a* and a second formation zone 14*b*; then treating the second formation zone 14*b*; and then applying a positive pressure differential from the first formation zone 14*a* to the second formation zone 14*b*, thereby displacing a plug 28 out of the well barrier 24.

In any of the examples described herein:

The applying step may include shearing a shear member 44 that releasably secures the plug 28 to an inner mandrel 32 of the well barrier 24.

The step of treating the second formation zone 14*b* may include shearing a shear member 44 that releasably secures the plug 28 to an inner mandrel 32 of the well barrier 24.

The method may include, after the step of treating the second formation zone 14*b*, applying a positive pressure differential from the second formation zone 14*b* to the first formation zone 14*a*, thereby shearing a shear member 44 that releasably secures the plug 24 to an inner mandrel 32 of the well barrier 28.

The method may include the plug 28 degrading in the well after the displacing step.

The displacing step may include exposing a degradable material 54 of the plug 28 to wellbore fluid, thereby causing the plug 28 to degrade in the well.

The displacing step may include exposing a degrading material 70 of the plug 28 to wellbore fluid, thereby causing the degrading material 70 to degrade a material 54 of a body 52 of the plug 28.

A well treatment system 10 for use with a subterranean well is also described above. In one example, the well system 10 can include a well barrier 24 set in the well, the well barrier 24 comprising a plug 28 that blocks fluid communication between sections of the well on opposite sides of the well barrier 24, and the plug 28 being releasably secured to an inner mandrel 32 of the well barrier 24. The plug 28 is released from securement to the inner mandrel 32 by application of a first positive pressure differential across the plug 28 in a first longitudinal direction, and fluid communication between the sections of the well on opposite sides of the well barrier 24 is unblocked by application of a second positive pressure differential across the plug 28 in a second longitudinal direction opposite to the first longitudinal direction.

In any of the examples described herein:

A shear member 44 may releasably secure the plug 28 in the inner mandrel 32. The first positive pressure differential may shear the shear member 44.

The plug 28 may continue to block fluid communication between the sections of the well on the opposite sides of the well barrier 24 after the shear member 44 is sheared, and while the first positive pressure differential is applied.

The plug may be displaced out of the inner mandrel 32 by the second positive pressure differential.

The plug 28 may degrade in the well in response to the displacement of the plug 28 out of the inner mandrel 32.

A degrading material 70 positioned in a body 52 of the plug 28 may be exposed to wellbore fluid in response to displacement of the plug 28 out of the mandrel 32.

Although various examples may be described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well barrier for use in a subterranean well, the well barrier comprising:

an inner mandrel;

a flow passage extending longitudinally through the inner mandrel; and a plug releasably secured relative to the inner mandrel, the plug blocking fluid flow through the flow passage, and the plug including a shoulder that prevents the plug from displacing completely through the inner mandrel in a first longitudinal direction, in which the plug is configured to release and displace out of the inner mandrel in response to application of a first positive pressure differential in the first longitudinal direction and in response to application of a second positive pressure differential in a second longitudinal direction opposite to the first longitudinal direction.

2. The well barrier of claim 1, in which at least one seal is sealingly engaged between the plug and the flow passage.

3. The well barrier of claim 2, in which the at least one seal comprises first and second seals, a body of the plug is coated with a coating material, and an area longitudinally between the first and second seals is not coated with the coating material.

4. The well barrier of claim 1, in which a degrading material is positioned in the body of the plug.

5. The well barrier of claim 1, in which a shear member releasably secures the plug in the flow passage.

* * * * *